US007055362B2

(12) United States Patent
Widmayer

(10) Patent No.: US 7,055,362 B2
(45) Date of Patent: Jun. 6, 2006

(54) APPARATUS AND METHOD FOR BENDING TUBING

(76) Inventor: Joseph B. Widmayer, 8803 N. Rood Rd., Kingston, IL (US) 60145

( * ) Notice: Subject to any disclaimer, the term of this patent is extended or adjusted under 35 U.S.C. 154(b) by 0 days.

(21) Appl. No.: 11/178,859

(22) Filed: Jul. 11, 2005

(65) Prior Publication Data

US 2006/0005601 A1 Jan. 12, 2006

Related U.S. Application Data

(60) Provisional application No. 60/590,069, filed on Jul. 12, 2004.

(51) Int. Cl.
*B21D 7/04* (2006.01)

(52) U.S. Cl. ..... 72/458; 72/459

(58) Field of Classification Search ..... 72/458, 72/459, 460, 37, 369, 157, 482
See application file for complete search history.

(56) References Cited

U.S. PATENT DOCUMENTS

| | | | | |
|---|---|---|---|---|
| 1,761,798 | A * | 6/1930 | Potter | 72/458 |
| 1,835,264 | A * | 12/1931 | Blythe | 72/459 |
| 1,899,281 | A * | 2/1933 | Lidseen | 72/458 |
| 2,349,525 | A * | 5/1944 | St. Clair | 72/458 |
| 2,998,838 | A * | 9/1961 | Byrd, Jr. | 72/458 |
| 4,926,672 | A * | 5/1990 | Swanson | 72/458 |
| 5,058,407 | A * | 10/1991 | Parker | 72/37 |
| 6,457,344 | B1 * | 10/2002 | Godin | 72/458 |

OTHER PUBLICATIONS

Griffin, J. (Jun. 2005), *Conduit Benders*, Electrical Contractor, (web pages excerpt consisting of 4 pages), http://www.ecmag.com/editorial_detail.aspx?id=1196.

Lidseen Chicago Benders (Mar. 2004) (web page excerpt consisting of 6 pages, including product information), http://www.chicagobender.com/chicagobender/features.html.

Associated Electric Products, Inc. (Mar. 2004) (web page excerpt consisting of 3 pages, including product Information) http://www.assoc-elec-prod.com/.

Burkhart Mfg. Co., Inc., Burkey Bender Precision Conduit Bender product Information (Jul. 8, 2004) (web page excerpt consisting of 7 pages) http://www.conduitbender.net/conduit-bender.html.

Ideal Bender Guide, Ideal Industries, Inc. (product Information booklet consisting of 4 pages).

* cited by examiner

*Primary Examiner*—David Jones
(74) *Attorney, Agent, or Firm*—Pauley Petersen & Erickson

(57) ABSTRACT

An apparatus and method for bending a tube, a pipe, a conduit and/or a rod. A bender is rotatably mounted with respect to a frame. A guide element, such as a guide roller, is mounted with respect to the frame. The guide element or the guide roller can be fixed or can move with respect to the frame. The combination of the frame, the bender and the guide element can be conveniently transported, assembled, disassembled and used at any job site or construction location.

20 Claims, 2 Drawing Sheets

APPARATUS AND METHOD FOR BENDING TUBING

This application claims the beneffit of Provisional Application No. 60/590,069 filed Jul. 12, 2004.

BACKGROUND OF THE INVENTION

1. Field of the Invention

This invention relates to a method and apparatus for bending tubing, such as electrical conduit.

2. Discussion of Related Art

Conventional conduit benders are typically used in the field at a commercial, residential or industrial construction site to bend conduit pipe or electrical metallic tubing (EMT). Power benders are typically used to bend EMT having a diameter greater than about 1 inch. Even though power benders can be used for smaller diameter tubing, hand benders having a shoe and a handle are used to roll the conduit between the hand bender and typically a ground or floor surface. Many commercial, residential and industrial construction sites require hundreds, some even thousands, of custom bent EMT pieces which are typically joined together to form a structured EMT network, sometimes having an elaborate configuration, through which wire is routed. Many EMT pieces require multiple bends. With so many bends it is often time and cost inefficient to use a power bender.

EMT pieces often require several bends that are made sequentially in the field, by measuring and forming a first bend and then holding the EMT piece in place to measure or estimate the size and location of the next sequential bend. Many EMT runs are positioned or located in an area that is accessed only by scaffolding, a lift or a ladder, which makes the installation task inefficient, difficult and impractical because of continually climbing up and down, to and from, the elevated area to access a hand bender or power bender which is located on a ground surface or on a different floor level.

Most EMT at a residential site has a diameter of one inch or less, and typically has a diameter of ½ inch to ¾ inch. Most EMT at a residential construction site is bent or formed by hand, in the field or at the job site, by an electrician using a conventional hand bender. A bending shoe of the hand bender often has a groove that matches an outer diameter of the EMT, and also supports an inside radius and outer walls of the EMT, during a bend process. Hand benders are used to roll the EMT between the hand tool and the floor surface, to gradually increase a radius of the bend. Many conventional hand benders have a hook at one end of the shoe, for gripping the EMT and pulling the EMT away from the ground surface or the floor, to form a bend.

The EMT is positioned within or rides within the groove formed by the shoe. The shoe is rotated or moved with respect to the floor or the ground surface, about a periphery of the shoe. Because residential sites and even many commercial and industrial sites require so much conduit less than one inch in diameter, electricians exert undue stresses and forces on their backs and other body parts, particularly when bending over multiple times, even hundreds of times per day, to first lift the EMT from the ground surface or the floor, carry the EMT to a bender, and then bend the EMT. In a typical work day, an electrician can be required to bend conduit as many as 300 to 500 times.

Not only does the manual bending process exert undue stresses on the body, but also operating the hand bender at an elevated location, such as on scaffolding, a ladder or a lift, is dangerous and can cause a safety hazzard.

It is apparent that there is a need for a bending apparatus that can stand on a ground surface, can be mounted upon scaffolding or a wall, or can be mounted upon any other similar construction or other structure.

There is a need for a bending apparatus that does not require the user to operate a bending tool against a floor surface or a ground surface.

There is a need for a bending apparatus that has a simple, rugged construction that is lightweight and portable, and that is relatively inexpensive.

There is a need for a bending apparatus that conveniently accommodates a conventional hand bender, particularly without the need for an electrician or other user to bend over or stoop and use the floor or ground to bend the EMT.

SUMMARY OF THE INVENTION

It is one object of this invention to provide a bending apparatus for bending a tube, a pipe, a conduit and/or a rod without working a bending tool against a ground surface or a floor surface.

It is another object of this invention to provide a bending apparatus that can be mounted on a wall or another suitable structure.

The above and other objects of this invention are accomplished with a bending apparatus having a frame and a bender rotatably mounted with respect to the frame. The bender can accommodate either a conventional hand bender or a custom hand bender.

In certain embodiments of this invention, a shaft is rotatably or pivotally mounted with respect to the frame. The bender can have a sleeve or other similar structure for detachably connecting one or more differently sized conventional and/or custom benders, using any suitable mechanical fastener or an adhesive. Using detachable connections for different components of this invention increases the versatility of the bending apparatus, for example by allowing the bending apparatus to accommodate differently sized and/or shaped conduits or tubes. Using fixed or secured connections, such as welded connections, may have a lesser associated cost but may also result in a less versatile bending apparatus.

When assembled, a shoe of the bender is preferably aligned with, positioned next to, and/or positioned over a guide element which is mounted directly to or with respect to the frame, at a distance from the bender.

A method for bending, according to this invention, includes loading a conduit or tube to be bent into the shoe of the bender. Then the bender is rotated, for example by operating a handle of the bender, to move the bender with respect to the frame and thus bend the conduit or tube. Different markings or scales can be used to gage the extent or degree to which the conduit or tube is bent.

In certain embodiments of this invention, the bender includes a shaft that is connected directly to or with respect to a sleeve or other structural component used to attach a handle and/or a shoe.

When initially loaded into the bending apparatus, the conduit or tube can be supported by a plate or other structural support member. The bending apparatus of this invention can be easily assembled and disassembled into components or pieces that can be conveniently and safely carried to different locations at a construction site, for example to elevated locations accessible by scaffolding, a ladder or steps.

The bending apparatus of this invention can also include one or more mounting elements to fix a position of the frame with respect to a structural support. For example, the mounting element can be shaped as a hook which can be detachably attached to scaffolding or a ladder. The mounting element can also include one or more tabs or bars that contact and interfere with, for example, wall studs or other structural supports at a construction or work site. Also, the mounting elements may include the frame or any other piece connected with respect to the frame having one or more bores through which pins or bolts can be positioned and inserted into or with respect to a wall or other similar structure.

A method for bending conduit or a tube, according to this invention, can significantly reduce physical stresses to the body of a user, such as an electrician, and can be conveniently and safely transported, assembled, used and disassembled at a job site.

BRIEF DESCRIPTION OF THE DRAWINGS

The features of this invention can be better understood when this specification is read in view of the drawings, wherein.

DETAILED DESCRIPTION OF THE INVENTION

Figure 1:
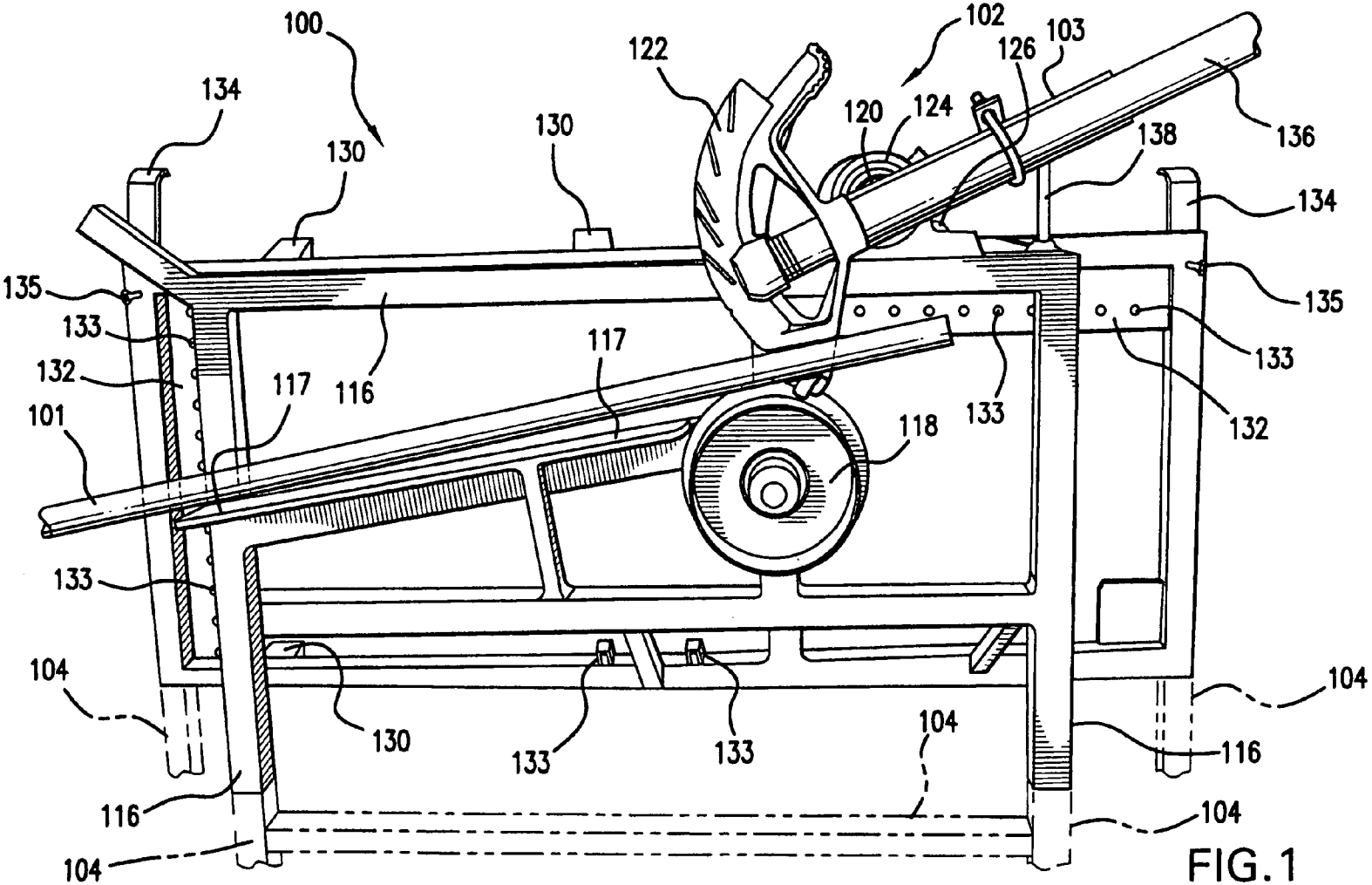
FIG. 1 is a front view of a bending apparatus, with a bender rotatably mounted, according to one embodiment of this invention.

FIG. 1 shows one embodiment of bending apparatus 100, according to this invention. Bending apparatus 100 can be used to bend a tube, a pipe, a conduit and/or a rod 101. Bending apparatus 100 can be used to bend other elongated members. As used throughout this specification, the term tube is intended to relate to and be interchangeable with any one or more of the terms pipe, conduit, EMT, rod and elongated member. Although bending apparatus 100 is often used for bending conduit such as electrical conduit or EMT, bending apparatus 100 can be used to bend any solid, hollow, tubular or other similar elongated member.

Figure 2:
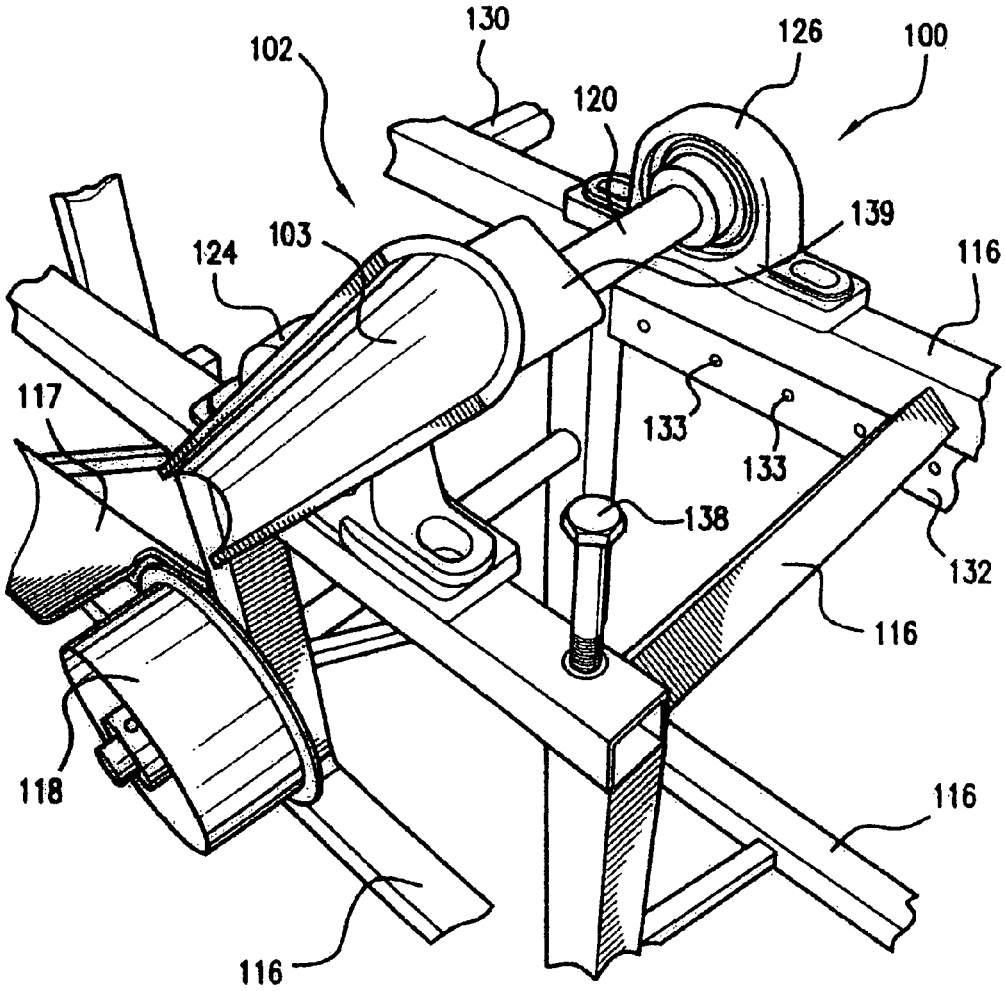
FIG. 2 is a top perspective partial view of bending apparatus, without a bender mounted, according to one embodiment of this invention.

As shown in FIGS. 1 and 2, bending apparatus 100 comprises frame 116 which enables a user to operate bending apparatus 100 at a convenient height above the ground surface. Stand 104, which is shown in phantom lines in FIG. 1, can be mounted to or positioned under frame 116 for supporting frame 116 at a higher level above a floor or ground surface, for example to further elevate or change the working level of bending apparatus 100. Stand 104 can be adjustable for adapting to different working heights of different users.

Bender 102 is rotatably mounted with respect to frame 116. If desired, bender 102 can be power assisted by operably connecting a motor and/or a controller to or with respect to any suitable element of bender 102. Guide element 118 is mounted with respect to frame 116, at a selected distance from bender 102. With bending apparatus 100 in an assembled condition, bender 102 is alignable with or can be aligned to or over guide element 118, to accept tube 101, such as shown in FIG. 1.

Frame 116 and/or stand 104 can have any suitable size, shape and/or configuration, depending upon the intended use for bending apparatus 100 and the specific location at which tube 101 is bent, such as for construction purposes. Frame 116 and/or stand 104 can have at least one bore 133, for mounting frame 116 with respect to any other structure, such as one or more structural members existing at a construction site. Bores 133 can be differently sized, shaped and/or can have different distances between each other, to better facilitate the attachment of frame 116 with respect to another structural member. Bores 133 can be within actual components of frame 116 or can be within components fixed or attached with respect to frame 116, such as within plate 132 which is fixed with respect to frame 116. The two bores 133 shown in FIG. 1, on the lower horizontal member of frame 116, can be used to attach frame 116 to another structural member, such as a scaffold or a lift. For example, a U-clamp can pass through both bores 133 and can be attached to the scaffold or the lift. Other suitable connectors can be used in lieu of or in combination with one or more bores 133.

At least one mounting element 130 can be fixed with respect to frame 116 and/or stand 104. A plurality of mounting elements 130 can be differently sized, shaped and/or positioned with respect to each other, to help fix or stabilize the relative position of frame 116 when bending tube 101. For example, two or more mounting elements 130 can be sized, shaped and positioned on frame 116, so that mounting elements 130 fit between structural members existing at a construction or work site. For example, two or more mounting elements 130 can be sized and positioned to fit between wall studs, which are typically constructed on 16-inch distances between centerlines of two adjacent wall studs. The properly sized and fitted mounting elements 130 can contact the wall stud members, for example, to prevent frame 116 from rotating during the bending process. Bending larger diameter tubes 101 may require more torsional resistance to torques created during the bending process. Mounting elements 130 can be attached to an upper horizontal member of frame 116, such as shown in FIG. 2 and/or can be attached to any suitable lower horizontal support member of frame 116, such as shown in FIG. 1. Two or more mounting elements 130 can be adjustably positionable with respect to each other, to accommodate differently sized openings between structural elements, such as differently sized or spaced wall studs.

Adapter frame 106 can be used to interchange portions or sections of frame 116, for example to accommodate differently sized tubes 101 and/or benders 102. Frame 116 may comprise any other interchangeable element or structural component that allows frame 116 to be differently sized and/or shaped. Different components of frame 116 can be detachably connected with respect to each other, for easy and convenient assembly and disassembly.

A tray can be connected either permanently or in a detachable manner, with respect to frame 116. The tray can be used for different purposes, such as to hold different small tools and/or parts. Frame 116 may also comprise one or more hooks 134 integrated with, connected to or attached with respect to frame 116, for example for hanging or suspending frame 116 on scaffolding or another structural support. FIG. 1 shows each hook 134 mounted within an opening of frame 116 and fixed in place with pin 135.

Shaft 120 and any suitable alternate shaft which can be interchanged with shaft 120 each acts as a pivot shaft that rotates or pivots with respect to frame 116. In one embodiment of this invention, shaft 120 is pivotally mounted with respect to frame 116. As shown in FIG. 2, shaft 120 is mounted within bearing 124 and bearing 126 but can also be mounted in one bearing or more than two bearings. Each bearing 124, 126 comprises an element that rotates or pivots with respect to frame 116. Any other suitable mechanical element or system that allows comparable pivotal or rotational movement of shaft 120 with respect to frame 116 can be used in lieu of bearings 124 and 126.

The alternate or supplemental shaft can be used, for example, to interchange differently sized handles 136 and/or shoes 122. In certain embodiments of this invention, bender 102 comprises sleeve 103 that is rotatable with respect to frame 116. Differently sized sleeves 103 can be used or interchanged with each other to accommodate differently sized handles 136. Handle 136 and/or shoe 122 may be a part of a conventional pipe bender, such as any of those often used by electricians to bend conduit. In some embodiments of this invention, handle 136 is fixed with respect to shaft 120 and thus shoe 122 can pivot with respect to frame 116. Sleeve 103 can be secured or detachably fixed with respect to shaft 120. Handle 136 can also be secured or detachably fixed with respect to sleeve 103 and/or shaft 120.

As shown in FIG. 2, sleeve 103 can have a channel, groove or other suitable void that accommodates an arm, handle and/or shaft of bender 102.

As shown in FIG. 1, bender 102 comprises shoe 122 that receives tube 101. Shoe 122 can be detachably connected to handle 136 or can be integrated with handle 136. Shoe 122 may be a conventional or a custom bending shoe. An end portion of shoe 122 may have a hook which is used to engage, grasp or grab tube 101, such as during a bending process.

Shoe 122 can be integrated with handle 136. Handle 136 can have an end portion configured to mate with handle extension 112. Shoe 122 can be custom formed to operate with any shape of tube 101.

With the hook of shoe 122 engaged about tube 101, such as shown in FIG. 1, shoe 122 is rotated, such as by shaft 120 rotating or moving within bearings 124 or 126, and tube 101 is forced around shoe 122 to form a bend. Shoe 122 can have markings or a scale, such as shown in FIG. 1, to gage a desired bend angle.

Any suitable handle extension can be attached to handle 136 to form a larger moment arm for bending heavier walled and/or larger diameter tubes 101. Support frame 116 can also include a structural member, such as the cross members shown in FIG. 2, to support or store one or more handle extensions when not in use.

Guide element 118 is mounted or secured with respect to frame 116. In certain embodiments of this invention, such as shown in FIGS. 1 and 2, guide element 118 comprises a roller rotatably mounted with respect to frame 116. The roller can be rotatably mounted directly to frame 116, or can be rotatably mounted with respect to frame 116. To begin a bending procedure or process, tube 101 is loaded into shoe 122, such as shown in FIG. 1, and then tube 101 is positioned against guide element 118. Shoe 122 is rotated with respect to frame 116 and causes tube 101 to slide against or make rolling contact with guide element 118. When guide element 118 rotates or otherwise moves with or in the same direction as shoe 122, there is reduced friction between the exterior surface of tube 101 and the exterior surface of guide element 118.

In one embodiment of this invention, with shaft 120 mounted within bearings 124, 126, shoe 122 is positioned over or aligned with guide element 118, such as shown in FIG. 1. Guide element 118 can be mounted to frame 116, adjacent shoe 122 and guide rail 117. Guide element 118 can have a peripheral surface or rim that combines with support member 117 to guide tube 101 through bending apparatus 100.

It is not necessary to rotatably mount guide element 118 with respect to frame 116. Other mechanical elements and/or systems can be used to move shoe 122 with respect to guide element 118. It is also possible for guide element 118 to be fixedly or securedly attached with respect to frame 116. As the diameter of tube 101 increases there is more of a desire to reduce friction by forming rolling contact rather than sliding contact between tube 101 and guide element 118.

In certain embodiments of this invention, guide element 118 can have peripheral or outer rims to contain tube 101 within guide element 118. However, in other embodiments of this invention, guide element 118 has no outer rim or one rim such as shown in FIG. 1, for easier insertion, removal and access of tube 101 within bender 102.

When tube 101 is initially loaded into bending apparatus 100, support member 117 can be mounted and positioned with respect to frame 116 to support tube 101 when mounted within bender 102. Support member 117 can include a plate shaped member as shown in FIG. 1, a bar, a combination of smaller support members or any other suitable structural support member. The relative angle of support member 117 can be designed, adjusted and/or varied to accommodate differently sized and/or differently shaped tubes 101.

Before or when loading tube 101 within bending apparatus 100, stop element 138 can be mounted with respect to frame 116 and positioned to interfere with complete rotation of bender 102 with respect to frame 116. A corresponding stop element 139 can be mounted with respect to bender 102, such as on handle 136 and/or shoe 122, to contact and thus interfere with stop element 138, also to prevent complete rotation of bender 102 with respect to frame 116. Either stop element 138 or 139 can be adjusted in height and thus position. For example, each stop element 138, 139 can be a threaded bolt, a tab or any other adjustable mechanical element.

Any suitable spring can be attached or fixed with respect to bender 102, sleeve 103, handle 136, shoe 122 and/or shaft 120, to apply a bias force to return shoe 122 to an original or starting position.

Handle 136, whether a conventional or custom design, can be detachably connected to sleeve 103 and/or shaft 120, using any clamp, screw or other mechanical connector or adhesive that provides detachable connection.

A pipe catch can be connected with respect to frame 116, for supporting one or more pieces of tube 101 in any suitable position, for easy access to a supply of tubes 101. The pipe catch or holder provides convenient access so that the user can minimize the frequency of bending or stooping movements, for example to pick up a supply length of tube 101.

The different components of bending apparatus 100 can be attached to frame 116 in a reverse manner or in a mirror image arrangement so that bending apparatus 100 bends pipe in opposite or different directions. The direction of bending can be reversed by interchanging components, such as shaft 120 and/or bender 102, to accommodate different bends for tube 101.

Conventional bending shoes 122 typically make it easier to insert, remove and access tube 101 from one particular side of shoe 122, and thus it may be easier to reverse components for easier access and handling of tube 101 within bending apparatus 100.

A method for bending tube 101, according to this invention, includes loading tube 101 into bender 102 which is rotatably mounted with respect to frame 116. Bender 102 is then rotated with respect to frame 116 and contacts tube 101 with guide element 118 which is mounted with respect to frame 116. Bender 102 is further rotated to bend tube 101 in a desired manner.

Use of the terms "a" and "and" and "the" in similar references in the context of describing this invention are to be construed to cover both the singular and the plural, unless otherwise indicated by the specification, the drawings and/or the claims. The terms "comprising" and "having" and "including" and "containing" are to be construed as open ended terms, such as meaning "including but not limited to," unless otherwise noted. Recitation of ranges of values are intended to serve as a shortened method of referring individually to each separate value falling within the range, unless otherwise indicated, and each separate value is incorporated into this specification as if it were individually recited in this specification. All methods described in this specification can be performed in any suitable order unless otherwise indicated. The use of any and all examples, or exemplary languages, for example "such as" in the specification is intended to only better illustrate the invention and does not pose or imply a limitation on the scope of this invention, unless otherwise claimed. No language in this specification should be construed as indicating any element not expressly described as being essential to the practice of this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of this invention.

What is claimed is:

1. A bending apparatus for bending at least one of a tube, a pipe, a conduit and a rod, the bending apparatus comprising:

a frame, a bender rotatably mounted with respect to the frame, a guide element mounted with respect to the frame at a distance from the bender, and the bender alignable with the guide element to accept the at least one of the tube, the pipe, the conduit and the rod, the bender comprising a shaft pivotally mounted with respect to the frame, and the shaft mounted within a first bearing rotatably mounted with respect to the frame and a second bearing rotatably mounted with respect to the frame.

2. The bending apparatus according to claim 1, wherein the bender comprises a sleeve that is rotatable with respect to the frame.

3. The bending apparatus according to claim 2, wherein the sleeve is fixed with respect to the shaft that it is rotatably mounted with respect to the frame.

4. The bending apparatus according to claim 2, wherein the sleeve has a channel that accommodates an arm of the bender.

5. The bending apparatus according to claim 1, further comprising a mounting element fixed with respect to the frame.

6. The bending apparatus according to claim 5, further comprising a second mounting element fixed with respect to the frame at a distance from the mounting element.

7. The bending apparatus according to claim 6, wherein the mounting element and the second mounting element are adjustably positionable with respect to each other.

8. The bending apparatus according to claim 1, wherein the frame comprises at least one bore for mounting the frame to a structure.

9. The bending apparatus according to claim 1, wherein the bender comprises a shoe that receives the at least one of the tube, the pipe, the conduit and the rod.

10. The bending apparatus according to claim 1, wherein the guide element comprises a roller rotatably mounted with respect to the frame.

11. The bending apparatus according to claim 1, further comprising a support member mounted with respect to the frame and positioned to support the at least one of the tube, the pipe, the conduit and the rod when mounted within the bender.

12. The bending apparatus according to claim 11, wherein the support member comprises a plate.

13. A method for bending at least one of a tube, a pipe, a conduit and a rod using the bending apparatus according to claim 1, the method comprising the steps of:

loading the at least one of the tube, the pipe, the conduit and the rod into the bender rotatably mounted with respect to the frame;

rotating the bender with respect to the frame and contacting the at least one of the tube, the pipe, the conduit and the rod with the guide element mounted with respect to the frame; and further rotating the bender to bend the at least one of the tube, the pipe, the conduit and the rod.

14. A bending apparatus for bending at least one of a tube, a pipe, a conduit and a rod, the bending apparatus comprising:

a frame, a bender rotatably mounted with respect to the frame, a guide element mounted with respect to the frame at a distance from the bender, and the bender alignable with the guide element to accept the at least one of the tube, the pipe, the conduit and the rod; and a stop element mounted with respect to the frame and positioned to interfere with complete rotation of the bender with respect to the frame.

15. The bending apparatus according to claim 14, further comprising a second stop element mounted with respect to the bender and positioned to interfere with the stop element mounted with respect to the frame.

16. The bending apparatus according to claim 14, wherein a stand is mounted with respect to the frame.

17. The bending apparatus according to claim 14, wherein the bender comprises a sleeve fixed with respect to ihe shaft that it is rotatably mounted with respect to the frame.

18. The bending apparatus according to claim 14, further comprising a mounting element fixed with respect to the frame.

19. The bending apparatus according to claim 14, wherein the guide element comprises a roller rotatably mounted with respect to the frame.

20. A bending apparatus for bending at least one of a tube, a pipe, a conduit and a rod, the bending apparatus comprising:

a frame, a bender fixed with respect to a shaft rotatably mounted with respect to the frame, a guide roller mounted with respect to the frame, and the bender having a shoe alignable with the guide roller to accept the at least one of the tube, the pipe, the conduit and the rod, wherein the shaft is mounted within a first bearing rotatably mounted with respect to the frame and a second bearing rotatably mounted with respect to the frame.

* * * * *